US008376504B2

(12) United States Patent
Miyazawa

(10) Patent No.: US 8,376,504 B2
(45) Date of Patent: Feb. 19, 2013

(54) FLUID EJECTING APPARATUS WITH HUMIDIFICATION MEMBER FOR MOISTURING INK

(75) Inventor: Hisashi Miyazawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 138 days.

(21) Appl. No.: 12/983,506

(22) Filed: Jan. 3, 2011

(65) Prior Publication Data

US 2011/0169886 A1 Jul. 14, 2011

(30) Foreign Application Priority Data

Jan. 8, 2010 (JP) ..... 2010-002692
Nov. 2, 2010 (JP) ..... 2010-245972

(51) Int. Cl.
*B41J 2/015* (2006.01)

(52) U.S. Cl. ..... 347/20; 347/47; 347/7; 347/28

(58) Field of Classification Search ..... 347/9–11, 347/20, 21, 22, 23, 25, 28, 44, 47
See application file for complete search history.

(56) References Cited

U.S. PATENT DOCUMENTS 7,682,009 B1 * 3/2010 Sliwa et al. ..... 347/95

FOREIGN PATENT DOCUMENTS

JP 2009-006682 1/2009

* cited by examiner

*Primary Examiner* — Juanita D Jackson
(74) *Attorney, Agent, or Firm* — Workman Nydegger

(57) ABSTRACT

A fluid ejecting apparatus, having a fluid ejecting head having a nozzle that ejects a fluid containing a solvent toward a target, includes a solvent holding member, disposed in a position that is opposite to a nozzle formation surface in which the nozzle of the fluid ejecting head is formed between the nozzle formation surface and the target but that is not opposite to the nozzle, that holds the solvent contained in the fluid.

7 Claims, 10 Drawing Sheets

FLUID EJECTING APPARATUS WITH HUMIDIFICATION MEMBER FOR MOISTURING INK

BACKGROUND

1. Technical Field

The present invention relates to fluid ejecting apparatuses such as ink jet printers or the like.

2. Related Art

Ink jet printers (called simply "printers" hereinafter) have been widely known for some time as fluid ejecting apparatuses that eject ink onto recording paper (a target). In such printers, there has been a problem in that thickening of the ink caused by the ink evaporating from the nozzles of a recording head has led to the occurrence of nozzle clogging. Accordingly, the printers normally carry out a flushing operation that forcefully ejects the ink within the nozzles, an operation that is separate from the ejecting of ink onto the recording paper. Furthermore, JP-A-2009-6682 discloses a liquid ejecting apparatus in which the liquid within the nozzles is resistant to thickening. In order to realize a fluid ejecting apparatus in which the liquid within the nozzles is resistant to thickening even without covering the nozzles, the liquid ejecting apparatus according to JP-A-2009-6682 includes the nozzles for ejecting the liquid and a humidification mechanism provided within a housing, the humidification mechanism humidifying the interior of the housing by heating or spraying the liquid outside of the nozzles in order to suppress thickening of the liquid within the nozzles.

Incidentally, with the liquid ejecting apparatus according to JP-A-2009-6682, a wide area within the housing is humidified, and thus a large amount of energy and evaporation medium (water or the like) is necessary. This issue is particularly serious in printers that have large capacities, such as line-head printers, large-size printers, and so on. Furthermore, humidifying the interior of the housing also results in the humidification of the printing paper surface, paper that is standing by for printing, and so on, and because the humidity within the paper has risen as a result, there has been a problem in that ink that has been ejected during printing does not dry easily.

Meanwhile, carrying out the aforementioned flushing operations wastes time. Furthermore, the operations for carrying out the flushing (movement to a flushing position) are necessary, and also waste ink.

SUMMARY

An advantage of some aspects of the invention is to provide a fluid ejecting apparatus capable of reducing flushing by evaporating a solvent in a narrow space in order to suppress thickening of a fluid at nozzle openings.

A fluid ejecting apparatus according to an aspect of the invention is a fluid ejecting apparatus that has a fluid ejecting head having a nozzle that ejects a fluid containing a solvent toward a target, and includes: a solvent holding member, disposed in a position that is opposite to a nozzle formation surface in which the nozzle of the fluid ejecting head is formed between the nozzle formation surface and the target but that is not opposite to the nozzle, that holds the solvent contained in the fluid.

According to this configuration, the solvent holding member that holds the solvent contained in the fluid is disposed in the vicinity of the nozzle opening between the nozzle formation surface of the fluid ejecting head and the target, the solvent in the solvent holding member evaporates within a narrow space that includes the nozzle opening, and the evaporation of the solvent in the fluid at the nozzle opening in the fluid ejecting head is suppressed. This makes it possible to suppress thickening of the fluid at the nozzle opening. As a result, flushing processes can be suppressed.

In a fluid ejecting apparatus according to another aspect of the invention, the distance between the nozzle and the solvent holding member is less than an evaporation border layer, the evaporation border layer being a range to which the solvent evaporates from the solvent holding member.

According to this configuration, the nozzle is located within the solvent evaporation range of the solvent holding member. Accordingly, the evaporation of the solvent in the fluid at the nozzle opening can be suppressed with certainty by the evaporated solvent.

In a fluid ejecting apparatus according to another aspect of the invention, the solvent holding member is a thread-shaped member having a diameter that is 10 to 50 times the diameter of the nozzle.

According to this configuration, the thread-shaped member is smaller than the distance between the nozzle and the target, and thus the thread-shaped member can be disposed without coming into contact with the target. Furthermore, the thread-shaped member can hold the amount of solvent required to suppress thickening.

In a fluid ejecting apparatus according to another aspect of the invention, the solvent holding member is a twisted string.

According to this configuration, the solvent holding member is a twisted string, the replacement thereof is simple, resulting in superior exchangeability.

In a fluid ejecting apparatus according to another aspect of the invention, the solvent holding member is made of a porous material, and a through-hole through which the fluid ejected from the nozzle passes is formed in a location in the porous material that corresponds to the nozzle of the fluid ejecting head.

According to this configuration, the solvent holding member is a porous material, and thus exhibits superior solvent retention performance.

In a fluid ejecting apparatus according to another aspect of the invention, an evaporation prevention layer is formed on the surface of the solvent holding member made of the porous material that is on the opposite side to the nozzle of the fluid ejecting head.

According to this configuration, the evaporation prevention layer is formed on the surface of the solvent holding member made of the porous material that is on the opposite side to the nozzle of the fluid ejecting head, and thus the evaporation of solvent from areas aside from through-holes can be suppressed.

A fluid ejecting apparatus according to another aspect of the invention further includes a solvent supply unit that supplies the solvent to the solvent holding member.

According to this configuration, the solvent is supplied to the solvent holding member by the solvent supply unit, and thus the solvent can be evaporated from the solvent holding member in a continuous manner.

BRIEF DESCRIPTION OF THE DRAWINGS

The invention will be described with reference to the accompanying drawings, wherein like numbers reference like elements.

FIG. 2A is a bottom view schematically illustrating the primary elements of a printer according to a first embodiment, whereas FIG. 2B is a side view schematically illustrating the primary elements of the same printer.

FIG. 7A is a bottom view schematically illustrating the primary elements of a printer according to a second embodiment, whereas

FIG. 9A is a bottom view schematically illustrating the primary elements of a printer according to a third embodiment, whereas

FIG. 12A is a bottom view schematically illustrating the primary elements of a printer according to a fourth embodiment, whereas

FIG. 13A is a bottom view schematically illustrating the primary elements of a printer according to a different example, whereas

FIG. 14A is a bottom view schematically illustrating the primary elements of a printer according to a different example, whereas

FIG. 15A is a bottom view schematically illustrating the primary elements of a printer according to a different example, whereas

DESCRIPTION OF EXEMPLARY EMBODIMENTS

First Embodiment

Hereinafter, a specific embodiment of an ink jet printer (called simply a "printer" hereinafter), serving as an example of a fluid ejecting apparatus according to the invention, will be described based on the drawings. In particular, this embodiment illustrates a line-head printer having a recording head unit anchored across the entirety of the width direction of paper.

Note that the terms "depth direction", "horizontal direction", and "vertical direction" as used in the descriptions hereinafter refer respectively to the depth direction, horizontal direction, and vertical direction indicated by the arrows in FIG. 1 and FIG. 2.

Figure 1:
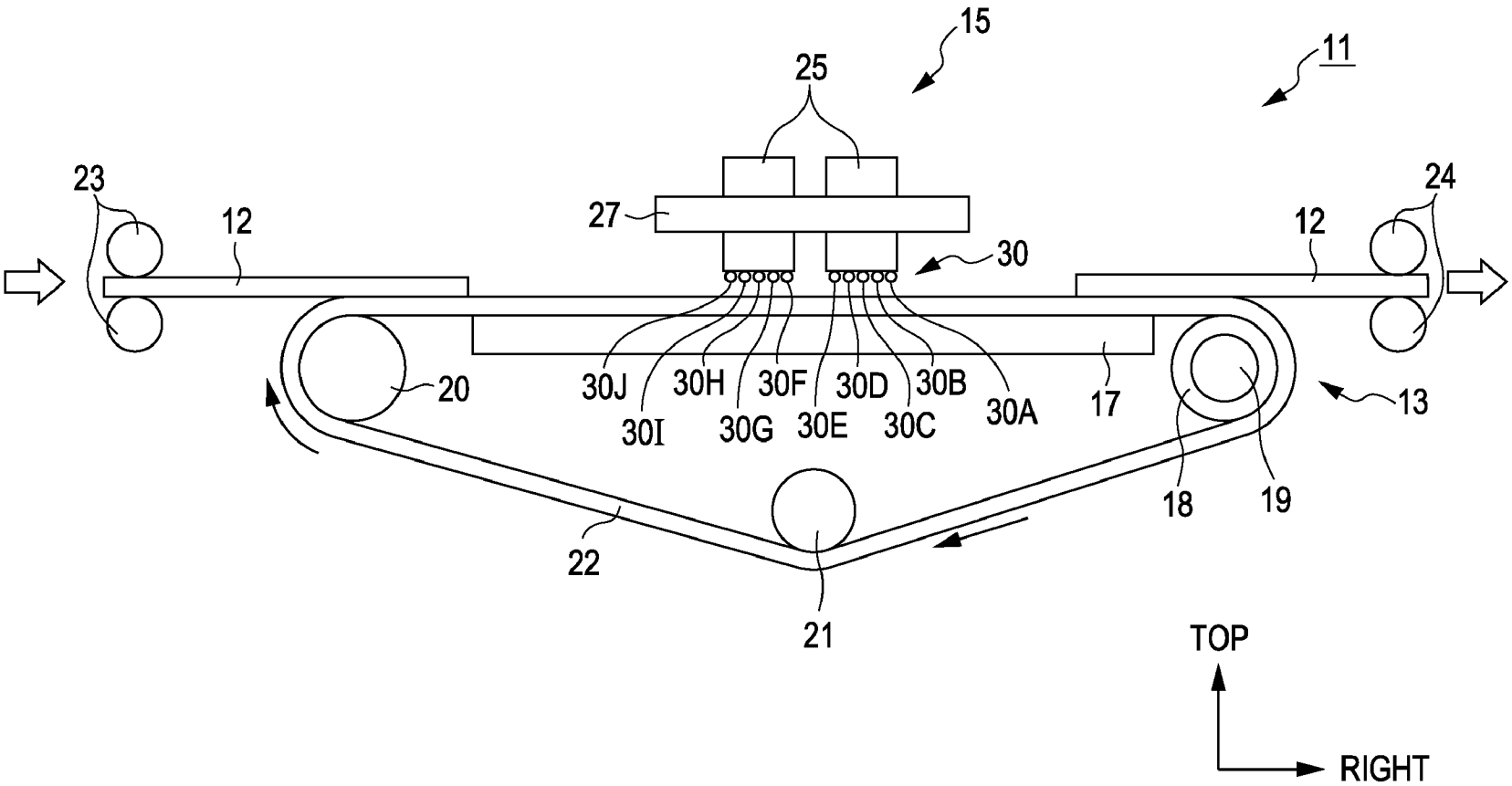
FIG. 1 is a front view schematically illustrating a printer according to a first embodiment.

As illustrated in FIG. 1, an ink jet printer 11 serving as a recording apparatus includes a transport unit 13 for transporting paper 12 that serves as a target, and a recording head unit 15. The recording head unit 15 is provided above the transport unit 13.

The transport unit 13 includes a platen 17, which has a long rectangular shape in the horizontal direction. A driving roller 18 that extends in the depth direction and that can be rotationally driven by a driving motor 19 is disposed to the right of the platen 17, whereas a slave roller 20 that extends in the depth direction and is capable of rotation is disposed to the left of the platen 17. Furthermore, a tension roller 21 that extends in the depth direction is disposed below the platen 17 so as to be capable of rotation.

An endless transport belt 22 having multiple through-holes is wound upon the driving roller 18, the slave roller 20, and the tension roller 21 so as to surround the platen 17. In this case, the tension roller 21 is biased in the downward direction by a spring member (not shown), and the transport belt 22 is suppressed from sagging by application of tension to the transport belt 22.

By rotationally driving the driving roller 18 in the clockwise direction as viewed from the front, the transport belt 22 makes revolutions around the outside of the driving roller 18, the tension roller 21, and the slave roller 20 in the clockwise direction as viewed from the front. In this case, the inside surface of the transport belt 22 slides along the upper surface of the platen 17 from the left to the right, and the paper 12 upon the transport belt 22 is transported from the left, which is the upstream side, to the right, which is the downstream side.

Meanwhile, in the case where the paper 12 is in a position that opposes the upper surface of the platen 17, the paper 12 is sucked toward the platen 17 over the transport belt 22 by a suction unit (not shown). In other words, the paper 12 that is in a position that opposes the upper surface of the platen 17 is supported by the platen 17 with the transport belt 22 therebetween.

Meanwhile, a pair of upper and lower paper feed rollers 23, for supplying multiple pieces of unprinted paper 12 to the surface of the transport belt 22 one piece at a time, is provided on the upper-left of the slave roller 20. Meanwhile, a pair of upper and lower paper discharge rollers 24, for discharging printed paper 12 from the surface of the transport belt 22 one piece at a time, is provided on the upper-right of the driving roller 18.

As shown in FIG. 1 and FIG. 2, the recording head unit 15 includes unit heads 25 (25A to 25E) serving as multiple (in this embodiment, five) fluid ejecting heads, and a rectangular-shaped plate 27 that supports the unit heads 25 (25A to 25E). The plate 27 is provided so as to oppose the platen 17.

Meanwhile, multiple (five, in this embodiment) rectangular-shaped interlocking holes corresponding to respective unit heads 25 (25A to 25E) are formed in the plate 27 so as to be disposed in a hound's-tooth pattern in the depth direction. Each unit head 25 is then attached, one at a time, so as to be interlocked with a respective interlocking hole in the plate 27. Each unit head 25 includes multiple rows (four rows) of nozzles 29, and the nozzles 29 open to a nozzle formation surface 28 on the bottom surface of the unit head 25. Ink serving as a fluid that includes a solvent is ejected from the nozzles 29 toward the paper 12. A water-based ink is used in this embodiment. In the recording head unit 15, the plate 27 is anchored to a solvent (not shown), thus realizing a configuration in which the recording head unit 15 can be moved to a maintenance position.

In addition, ten twisted strings 30 (30A to 30J) serving as solvent holding members (humidification members) are provided, and the twisted strings 30 (30A to 30J) are stretched in the depth direction, which is orthogonal to a paper transport direction. One end of each of the twisted strings 30 (30A to 30J) is supported by a first mobile support member 31 disposed on the forward side of the plate 27, whereas the other end is supported by a second mobile support member 32 disposed on the rear end of the plate 27. At this time, tension is applied to each of the twisted strings 30, thereby suppressing the twisted strings 30 from sagging. In other words, the twisted strings 30 are near the nozzle formation surface 28 of the unit heads 25 even at the central portions of the twisted strings 30 in the depth direction.

The first mobile support member 31 and the second mobile support member 32 are capable of moving in the transport direction of the paper 12 (that is, the horizontal direction), and thus the twisted strings 30 can be moved to a retracted position in which the twisted strings 30 are distanced from the nozzle formation surface 28 of the unit heads 25.

Figures 2A, 2B:
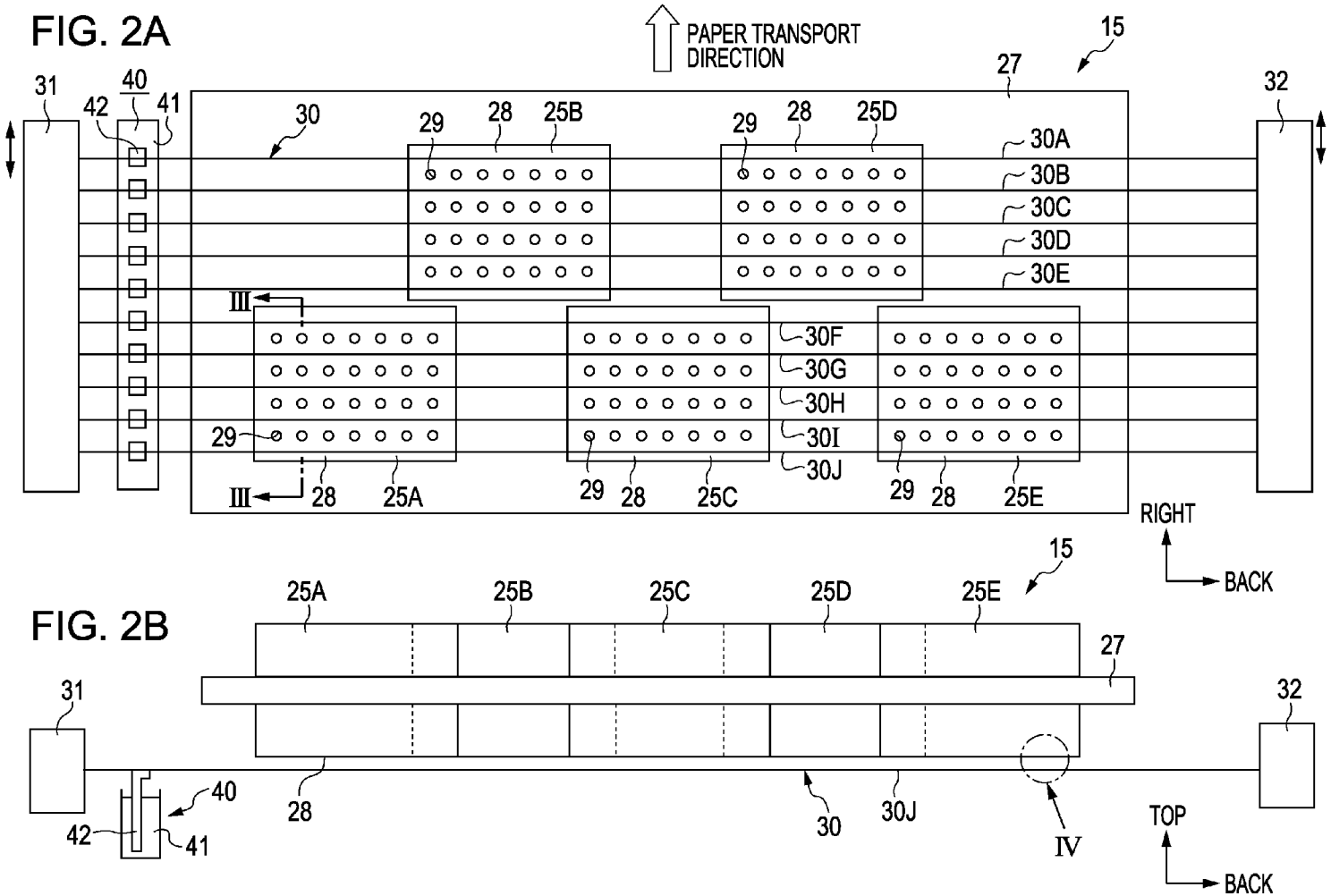
Figure 3:
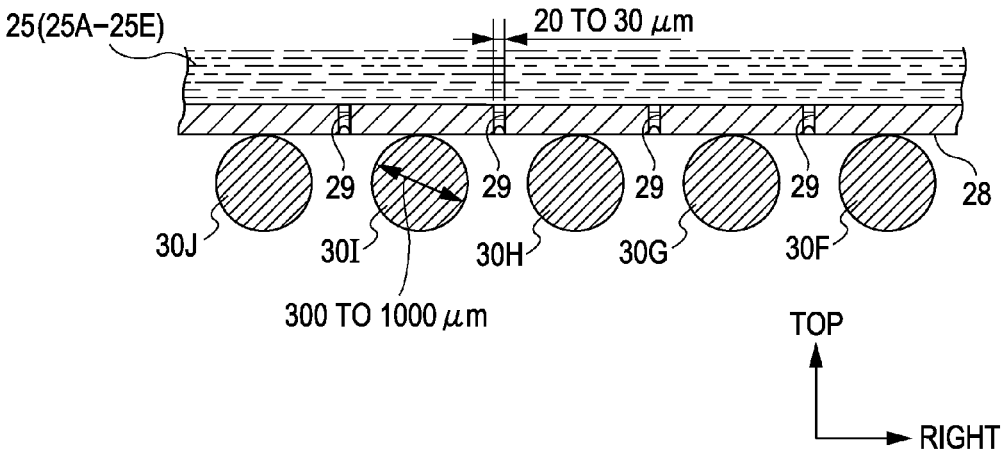
FIG. 3 is a cross-sectional view taken along the III-III line shown in FIG. 2A.

Each of the twisted strings 30 (30A to 30J) is disposed in a region that is between the nozzles 29 of the unit heads 25 and the paper 12 and that is opposed to the nozzle formation surface 28 as shown in FIG. 3, but that is not opposed to the nozzles 29. To be more specific, the twisted strings 30 make contact with the nozzle formation surface 28, or are extremely close thereto, in the vertical direction. The diameter of each of the twisted strings 30 (30A to 30J) is approximately 300 to 1,000 μm. Because the diameter of each of the nozzles 29 is approximately 20 to 30 μm, the diameters of the twisted strings 30 are 10 to 50 times the diameters of the nozzles 29. It should be noted that because the distance from the nozzle formation surface 28 to the paper 12 is approximately 1,500 to 3,000 μm, the twisted strings 30 are of a size whereby they do not make contact with the paper 12. In addition, the twisted strings 30 have multiple fiber bundles intertwined with each other or gathered together. With this kind of twisted string, water can also be held in the cavities between the respective fiber bundles, and thus the amount of water that can be held is greater than the amount of water that can be held with a single fiber bundle of the same diameter. Conversely, if the same amount of water is to be held, the diameter of the twisted strings can be reduced. Furthermore, as shown in FIG. 2A, the 10 twisted strings 30A to 30J are stretched so as to sandwich the four nozzle rows in the unit heads 25 (25A to 25E).

In other words, of the five unit heads 25A to 25E, in the two unit heads 25B and 25D, which are located on the downstream side in the paper transport direction, the twisted string 30A is disposed on the downstream side of the four nozzle rows and the twisted string 30E is disposed on the upstream side of the four nozzle rows, and the twisted strings 30B, 30C, and 30D are disposed, in that order, between the nozzle rows from the downstream side up. Likewise, of the five unit heads 25A to 25E, in the three unit heads 25A, 25C, and 25E, which are located on the upstream side in the paper transport direction, the twisted string 30F is disposed on the downstream side of the four nozzle rows and the twisted string 30J is disposed on the upstream side of the four nozzle rows, and the twisted strings 30G, 30H, and 30I are disposed, in that order, between the nozzle rows from the downstream side up.

Figure 4:
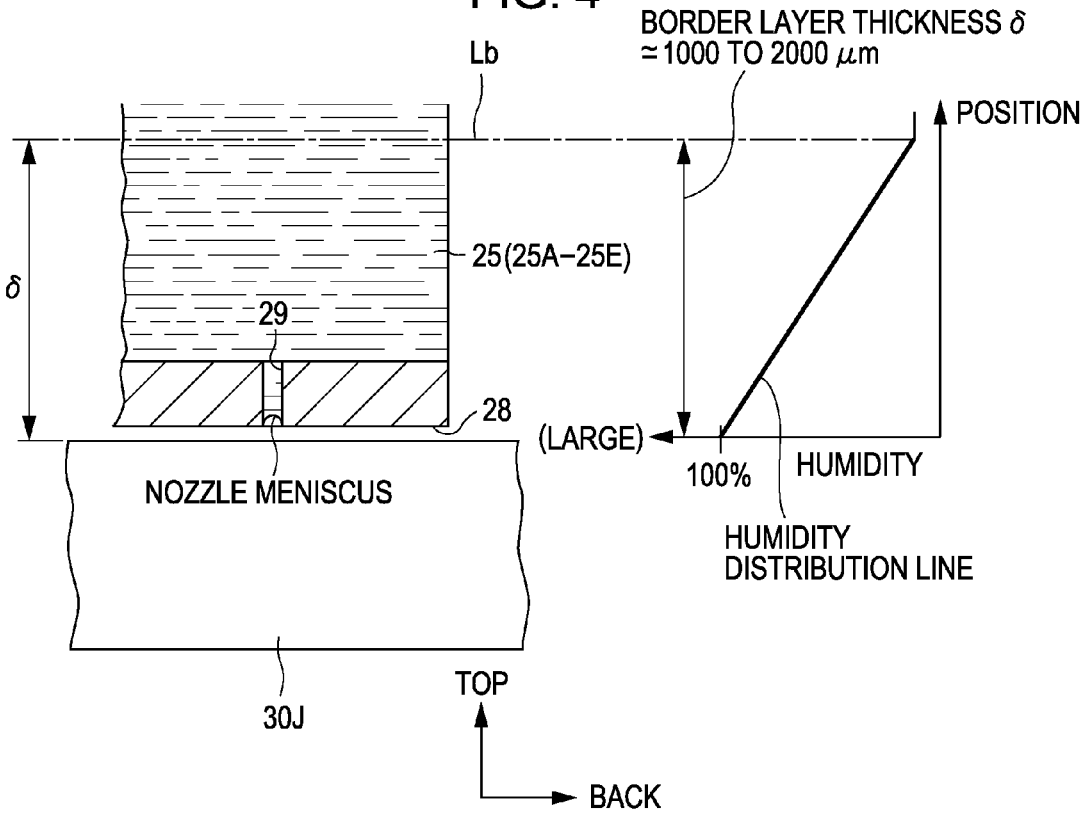
FIG. 4 is a diagram illustrating a cross-section and humidity distribution of an area IV illustrated in FIG. 2B.

Meanwhile, the twisted strings 30 (30A to 30J) hold water, serving as a solvent contained in the ink, due to capillarity. An evaporation border layer Lb, whose thickness δ is 1 to 2 mm (1,000 to 2,000 μm) as shown in FIG. 4, is formed by the water evaporation from the twisted strings 30 into the periphery. The nozzle openings of the unit heads 25 are positioned within this evaporation border layer Lb.

In this manner, the twisted strings 30, which serve as solvent holding members that hold water that is contained in the ink, are disposed in positions that oppose the nozzle formation surface 28 in which the nozzles of the unit heads are formed between the nozzle formation surface 28 and the paper 12, but in positions that do not oppose the nozzles 29. The distance between the nozzles 29 and the twisted strings 30 is less than the evaporation border layer Lb, which is the range to which the water evaporates from the twisted strings 30. The solvent holding members are the twisted strings 30, which are thread-shaped members having a diameter that is 10 to 50 times the diameter of the nozzle 29.

In FIG. 2, a tank 41 that holds water is disposed on one side of the twisted strings 30 (30A to 30J), and the water within the tank 41 is supplied to the twisted strings 30 (30A to 30J) through felt 42. In other words, the water within the tank 41 is absorbed by the felt 42 through the capillarity phenomenon, and is then supplied to the twisted strings 30. A hydration unit 40, serving as a solvent supply unit that supplies the water to the twisted strings 30, is thus configured of the tank 41 and the felt 42.

Next, effects of the printer 11 according to the embodiment having the configuration illustrated above will be described focusing on an effect through which the ink is suppressed from thickening at the nozzles using the twisted strings 30.

During printing operations, the water contained in the ink will evaporate at the nozzle openings of the unit heads 25.

Figure 5:
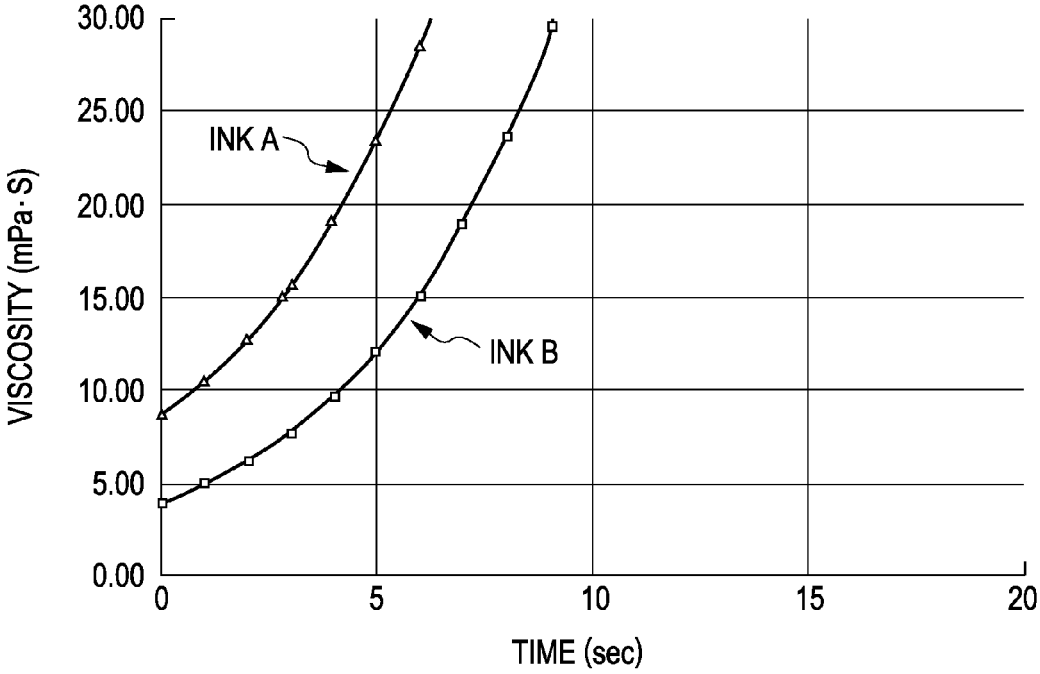
FIG. 5 is a graph illustrating a change in the viscosity of the ink over time at nozzle openings in the case where a twisted string that holds water is not disposed in the vicinity of the nozzle openings.

Here, differences in the changes in viscosity of the ink at the nozzle openings in the case where the twisted strings 30 holding water are disposed in the vicinity of the nozzle openings and the case where the twisted strings 30 are not disposed in the vicinity of the nozzle openings will be described with reference to FIGS. 5 and 6. The graph in FIG. 5 illustrates a change in the viscosity of the ink in past cases, in which the twisted strings 30 (30A to 30J) that hold water are not disposed in the vicinity of the nozzle openings between the nozzles 29 of the unit heads 25 (25A to 25E) and the paper 12. On the other hand, the graph in FIG. 6 illustrates a change in the viscosity of the ink at the nozzle openings, resulting from disposing the twisted strings 30 that hold water in the vicinity of the nozzle openings, in the case where the evaporation border layer Lb, having a thickness 6 of approximately 1 mm (1,000 μm) from the twisted strings 30 toward the nozzle formation surface 28, is formed.

Figure 6:
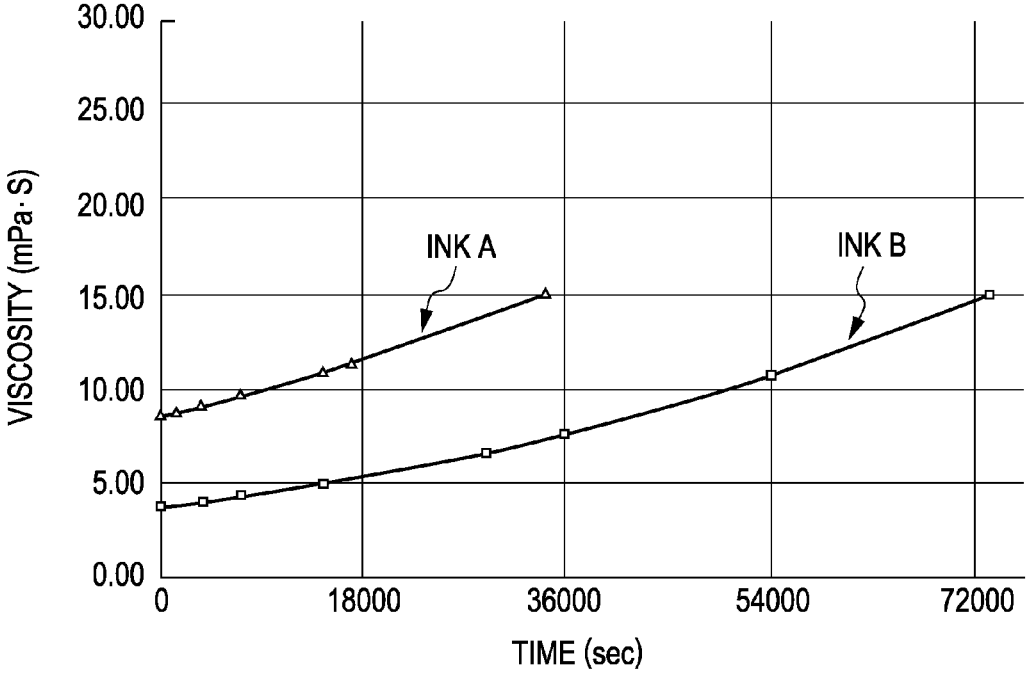
FIG. 6 is a graph illustrating a change in the viscosity of the ink over time at nozzle openings in the case where a twisted string that holds water is disposed in the vicinity of the nozzle openings.

Note that in FIGS. 5 and 6, the vertical axis represents the viscosity (mPa·S) of the ink, whereas the horizontal axis represents the passage of time. Both FIG. 5 and FIG. 6 illustrate the changes in viscosity over time of two types of ink (ink A and ink B) having different initial viscosities due to differences in the ink compositions. Incidentally, the ink A in this case is a pigment-based ink having an initial viscosity of approximately 8.5 mPa·S, whereas the ink B is a pigment-based ink having an initial viscosity of approximately 4.0 mPa·S.

As shown in FIG. 5, in the case where the twisted strings 30 that hold water are not disposed in the vicinity of the nozzle openings, the viscosity of the ink A increases from the initial viscosity of 8.5 mPa·S to 15.0 mPa·S in three seconds, whereas the viscosity of the ink B increases from the initial viscosity of 4.0 mPa·S to 15.0 mPa·S after approximately six seconds have passed. Here, there is a risk that the nozzles 29 will become clogged if the ink viscosity reaches approximately 15.0 mPa·S, and thus it is necessary to carry out so-called "flushing", in which ink is forcefully ejected from the nozzles 29 in a process that is separate from printing. Accordingly, in the case where the twisted strings 30 that hold water are not disposed in the vicinity of the nozzle openings, there will be an increase in a loss of time and a loss of ink resulting from repeated flushing processes.

As opposed to this, in the case where, as shown in FIG. 6, the twisted strings 30 that hold water are disposed in the vicinity of the nozzle openings, the viscosity of the ink A will reach 15.0 mPa·S just before approximately 36,000 seconds (10 hours) have passed, whereas the viscosity of the ink B will reach 15.0 mPa·S after approximately 72,000 seconds (20 hours) have passed, even if the printer is in the same temperature/humidity environment as that assumed in FIG. 5. This is because the water in the twisted strings 30 (30A to 30J) evaporates in the narrow peripheral space that contains the nozzle openings, thus increasing the humidity in the periphery of the nozzles 29. In other words, the periphery of the nozzle openings can be humidified with priority by providing the twisted strings 30, from which moisture evaporates, extremely close to the nozzle openings. Accordingly, the water in the ink can be suppressed from evaporating at the nozzle openings of the unit heads 25, thus making it possible to suppress the evaporation of moisture from the menisci of the nozzles in the unit heads, which in turn suppresses thickening in the ink at the nozzle openings.

As a result, it is possible to eliminate or reduce flushing processes performed when printing. By suppressing flushing processes in this manner, it is possible to reduce a loss in time and a loss of ink resulting from carrying out the flushing processes.

To be more specific, as shown in FIG. 4, the area extremely close to the nozzle menisci can be held at almost 100% moisture (that is, the evaporation border layer can be provided), making it possible to further suppress the evaporation of moisture from the nozzles 29. Accordingly, the effect of suppressing ink thickening can be increased, thus making it essentially unnecessary to carry out flushing processes or the like during printing. In addition, it is no longer necessary to hold unnecessary areas aside from the nozzle menisci at a high humidity, which makes it possible to suppress the amount of moisture evaporation; this in turn makes it possible to significantly reduce the consumption of water (the evaporation medium) by reducing the use of the evaporation medium (water) necessary for the humidification.

When printing operations end and maintenance is to be carried out, the mobile support members 31 and 32 are moved (retracted) in the paper transport direction, thus distancing the twisted strings 30 (30A to 30J) from the nozzle formation surface 28 of the unit heads 25. A cap is disposed for the nozzle formation surface 28 of the unit heads 25 at the maintenance position. Note that suction, wiping, and so on may also be carried out.

According to the first embodiment described thus far, the following effects can be achieved.

(1) Water is evaporated in the narrow space that contains the nozzle openings using the twisted strings 30 that are disposed in the vicinity of the nozzle openings and that hold water, thus making it possible to suppress the evaporation of water from the ink at the nozzle openings and suppress flushing processes.

(2) In situations where the water in the ink is likely to evaporate from the nozzles 29, it is also likely that water will evaporate from the twisted strings 30; humidification is carried out by evaporating moisture from the twisted strings 30 in accordance with the humidity in the vicinity of the nozzle menisci; and there is a low amount of humidification in environments in which the ink does not thicken quickly in the vicinity of the nozzle menisci. As described above, natural evaporation occurs based on the state of the thickening of the nozzle menisci, thus making it possible to automatically suppress such thickening.

(3) Because the distance between the nozzles 29 and the twisted strings 30 is smaller than the evaporation border layer, which is the range to which water evaporates from the twisted strings 30, the nozzles 29 are located within the water evaporation range of the twisted strings 30; accordingly, the evaporation of the water within the ink at the nozzle openings is suppressed with certainty by the evaporating water.

(4) Because the twisted strings 30 are used as the solvent holding member, the replacement thereof is simple, resulting in superior exchangeability. Furthermore, instead of a single string, multiple twisted strings are provided, and water can also be held between respective twisted strings; this increases the amount of moisture that can be held.

(5) The diameter of a single twisted string 30 is 10 to 50 times the diameter of a single nozzle 29, and thus the twisted strings 30 can be disposed so as not to come into contact with the paper 12 even when the twisted string 30 is disposed between the nozzle 29 and the paper 12. Furthermore, the twisted string 30 can hold the amount of moisture required to suppress thickening.

Accordingly, the solvent holding member is a thread-shaped member (the twisted string 30) having a diameter that is 10 to 50 times the diameter of the nozzles 29, and the threat-shaped member (the twisted string 30) is smaller than the distance between the nozzles 29 and the paper 12; accordingly, the thread-shaped member (the twisted string 30) can be disposed so as not to come into contact with the paper 12, and can hold the amount of moisture required to suppress thickening.

(6) Water is supplied to the twisted strings 30 by the hydration unit 40, and thus water can be evaporated from the twisted strings 30 in a continuous manner.

It should be noted that in the hydration unit, water may be retained in the twisted strings through capillarity, and water may be supplied from a water tank from a side of the unit head 25 (a location that is distanced from the unit head 25) so as to enable the uniformization of the moisture in the twisted strings 30 using a unit that feeds out the twisted strings that hold moisture, a take-up unit that collects the twisted strings from which the water has evaporated, and so on.

Furthermore, multiple twisted strings 30 (30A to 30J) may be used for a single nozzle row. Doing so makes it possible to increase the amount of evaporation and further suppress ink thickening at the nozzles.

Second Embodiment

Next, a second embodiment will be described using FIGS. 7A and 7B. Note that the second embodiment differs from the first embodiment only in that the configuration of the solvent supply unit has been changed; because the other configurations are common between the two embodiments, identical constituent elements will be assigned the same reference numerals and detailed descriptions thereof will be omitted.

Figure 7A:
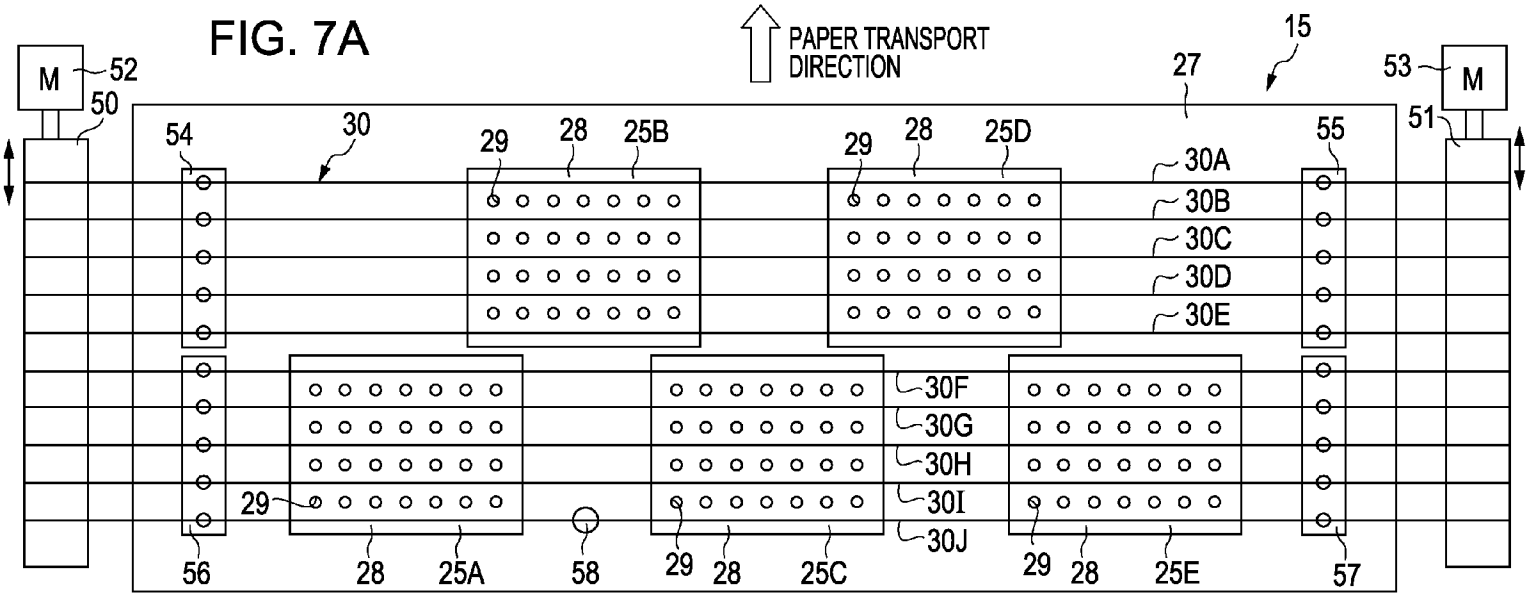
Figure 7B:
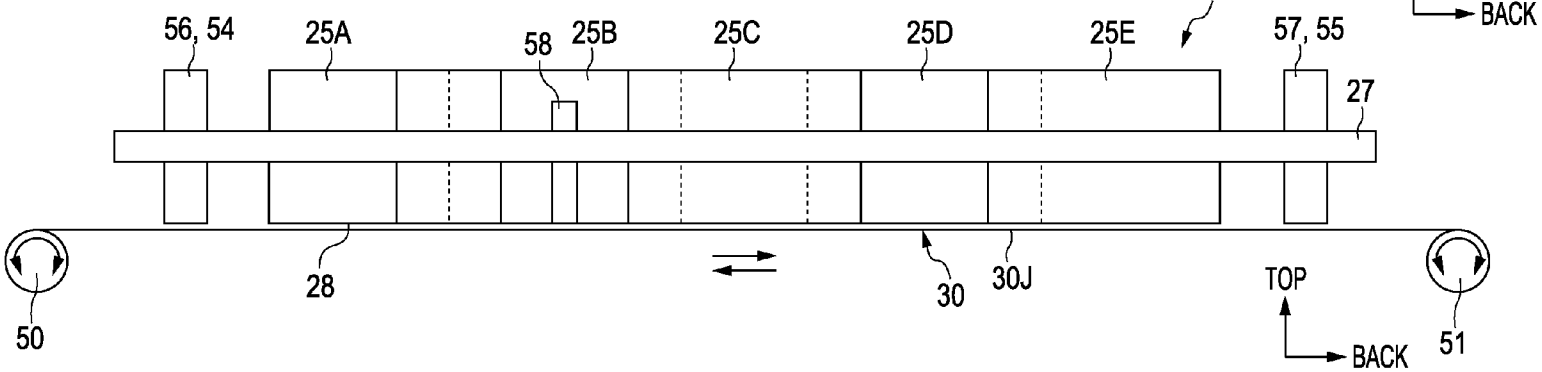
FIG. 7B is a side view schematically illustrating the primary elements of the same printer.

As shown in FIGS. 7A and 7B, in addition to unit heads 25 for line-printing, heads 54, 55, 56, and 57, serving as solvent supply units that eject water, are disposed on both sides of the unit heads 25 for printing. Furthermore, the twisted strings 30 (30A to 30J) are wound upon rollers 50 and 51. The rollers 50 and 51 are rotationally driven by motors 52 and 53. Furthermore, a humidity sensor 58 is provided for the twisted strings 30, the humidity sensor 58 making contact with the twisted strings 30 and detecting the moisture level thereof. Note that the moisture level can also be detected using a scheme that employs changes in frequency caused by changes in weight.

A drop in the moisture level of the twisted strings 30 detected by the humidity sensor 58 is taken as a hydration time, and water is ejected onto the twisted strings 30 by the heads 54, 55, 56, and 57; furthermore, the motors 52 and 53 are driven, causing the twisted strings 30 to travel, and moving the twisted strings 30 that have been moistened by the water ejected from the heads 54, 55, 56, and 57 to below the unit heads 25A to 25E used for printing.

Such heads that eject water can be employed favorably particularly in cases where highly-precise hydration is necessary.

Third Embodiment

Next, a third embodiment will be described using FIGS. 8 through 11. Note that the third embodiment differs from the first embodiment only in that the configurations of the solvent holding member and the solvent supply unit have been changed; because the other configurations are common between the two embodiments, identical constituent elements will be assigned the same reference numerals and detailed descriptions thereof will be omitted.

Figure 8:
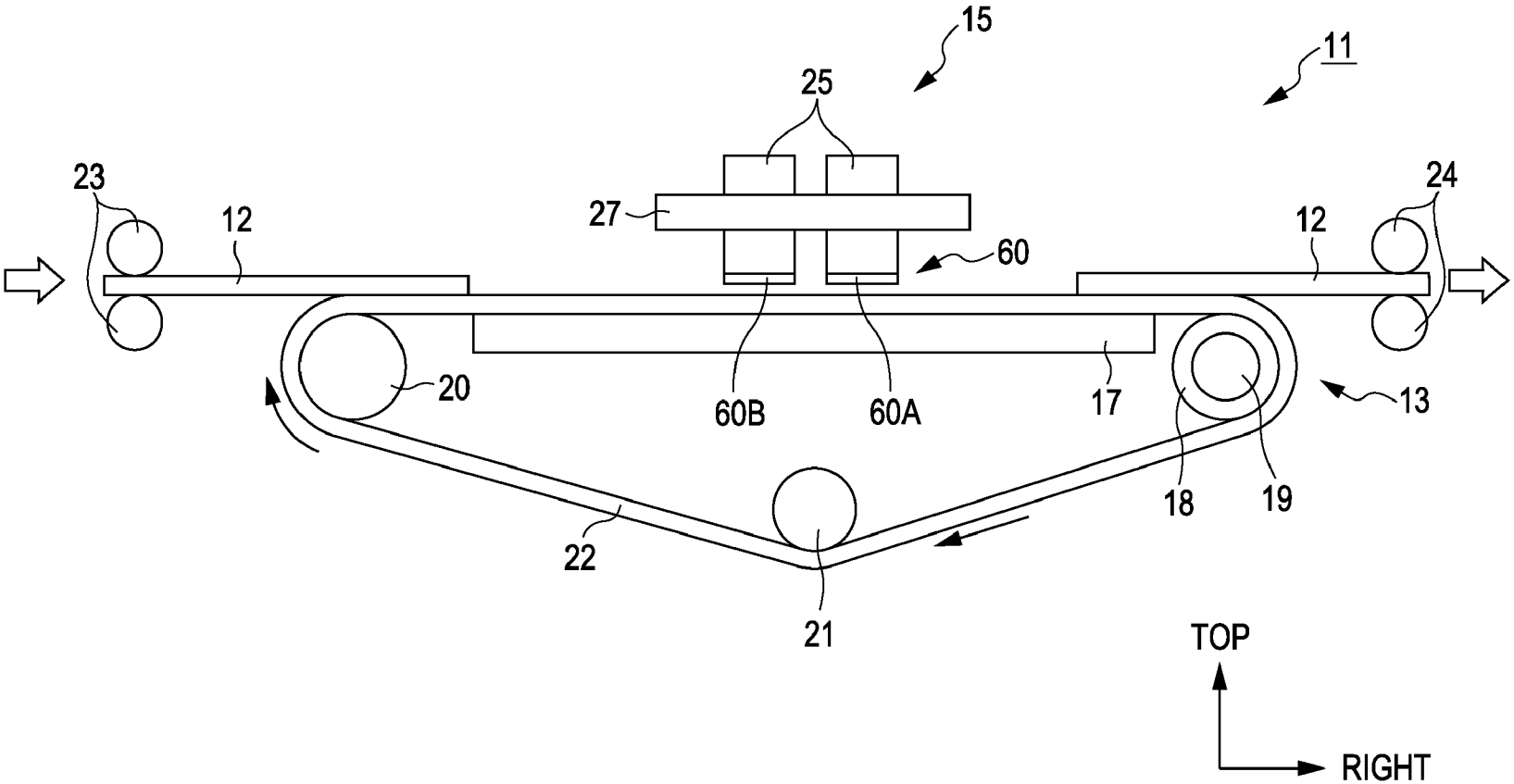
FIG. 8 is a front view schematically illustrating a printer according to a third embodiment.
Figure 9A:
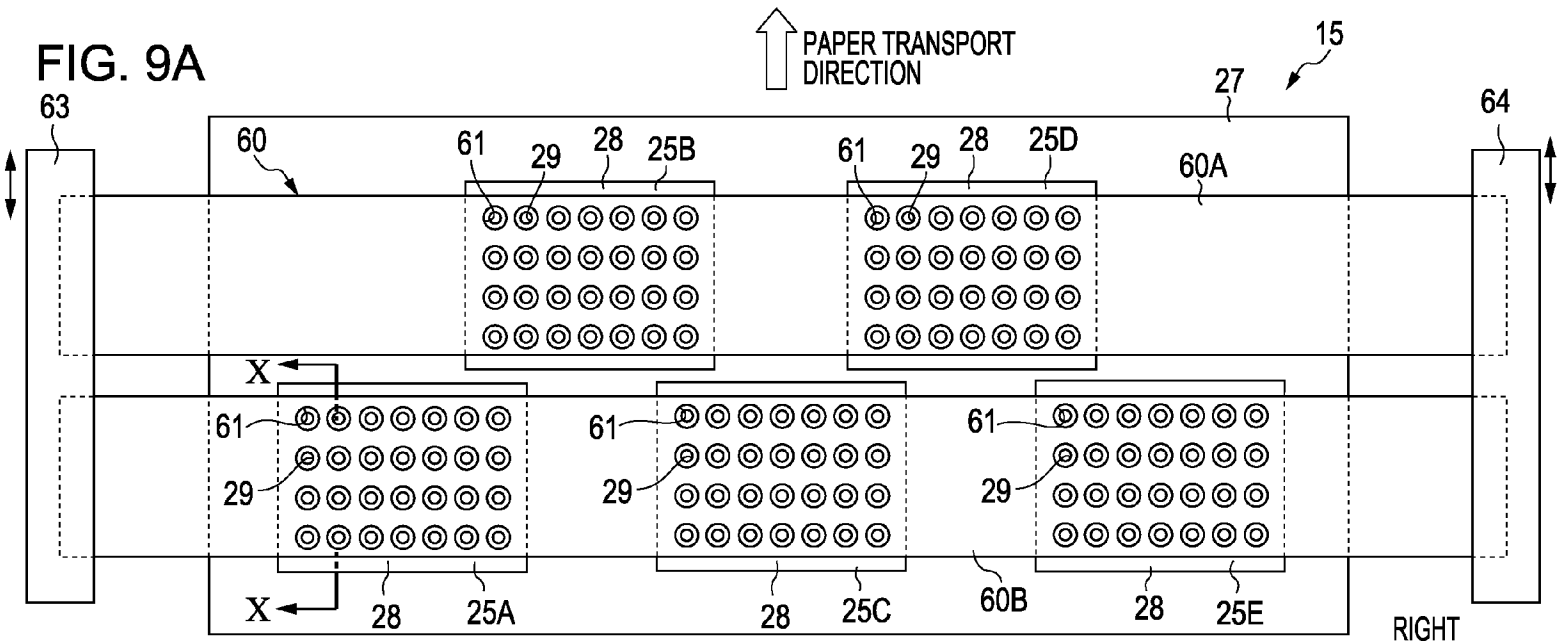
Figure 9B:
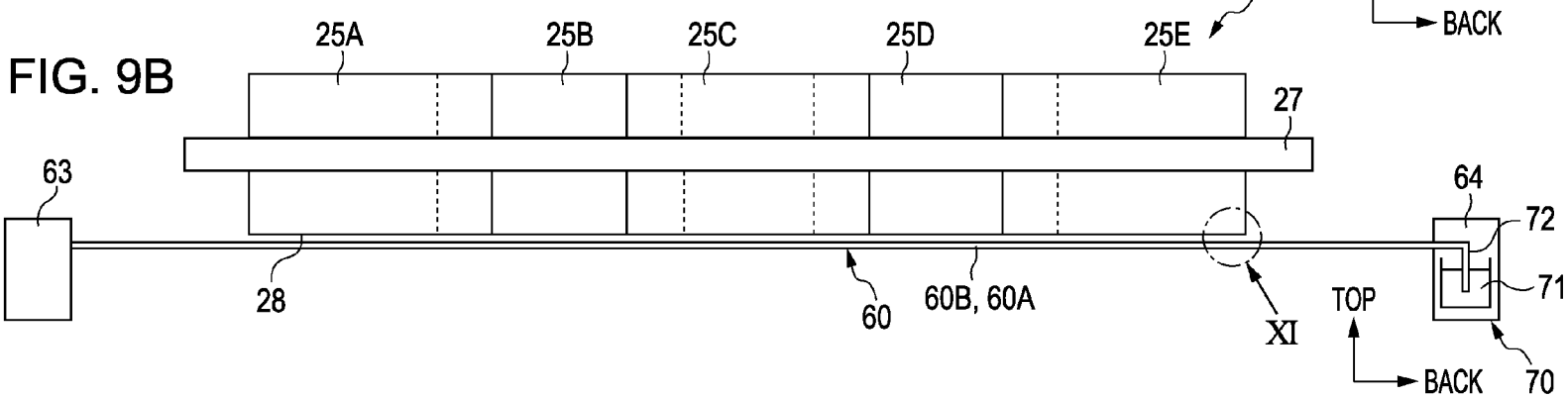
FIG. 9B is a side view schematically illustrating the primary elements of the same printer.

As shown in FIGS. 8, 9A and 9B, two porous plates 60 (60A and 60B) serving as solvent holding members are disposed on the bottom surface of the unit heads 25. The porous plates 60 are supported by a first mobile support member 63 disposed on the front side of the plate 27 and a second mobile support member 64 disposed on the rear side of the plate 27. The first mobile support member 63 and the second mobile support member 64 are capable of moving in the transport direction of the paper 12, and thus the porous plates 60 (60A and 60B) can be moved to a retracted position in which the porous plates 60 are distanced from the nozzle formation surface 28 of the unit heads 25.

Figure 10:
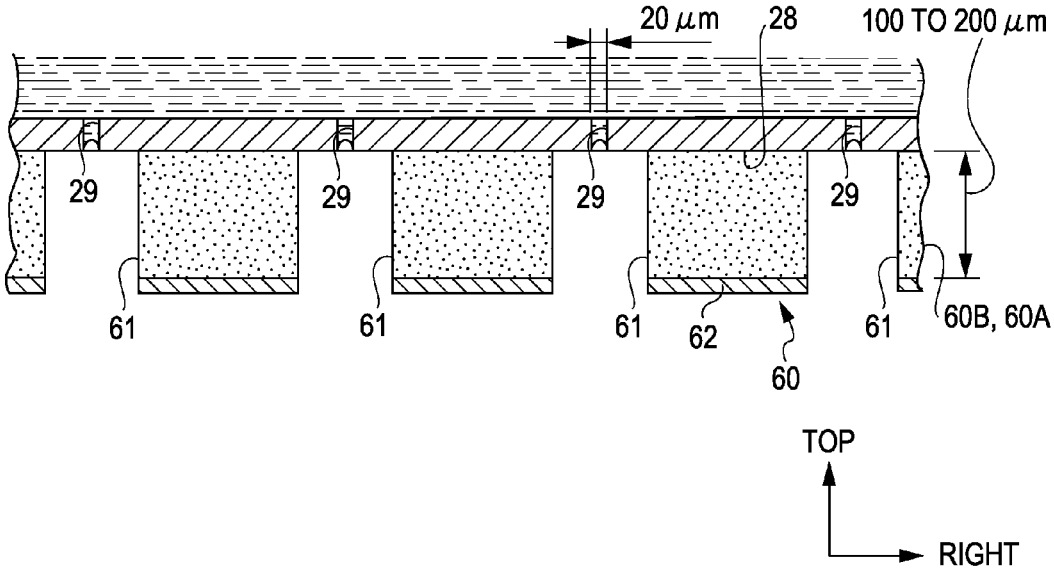
FIG. 10 is a cross-sectional view taken along the X-X line shown in FIG. 9A.

The porous plates 60 (60A and 60B) are flat plates made of a porous material, and are formed in a rectangular shape. The rectangular porous plates 60 extend in the depth direction, which is orthogonal to the paper transport direction. As shown in FIG. 10, the porous plates 60 (60A and 60B) each have a thickness of approximately 100 to 200 μm. Furthermore, the porous plates 60 (60A and 60B) are disposed so that the surfaces thereof make contact with or are close to the nozzle formation surface 28 of the unit heads 25. The porous plates 60 (60A and 60B) hold water through the effect of capillarity.

Circular through-holes 61 are formed in the porous plates 60 (60A and 60B) in locations corresponding to the nozzles 29 of the unit heads 25. The diameter of the through-holes 61 is greater than the diameter of the nozzles 29. The ink ejected from the nozzles 29 passes through these through-holes 61 and can be ejected toward the paper 12. Accordingly, the ink ejection is not obstructed by the porous plates 60 (60A and 60B).

In this manner, the porous plates 60 (60A and 60B), which have through-holes 61 of a size that does not obstruct the ejection of ink from the nozzles 29, are disposed between the paper transport surface and the nozzles 29 in a position that is extremely close to the nozzle openings.

Figure 11:
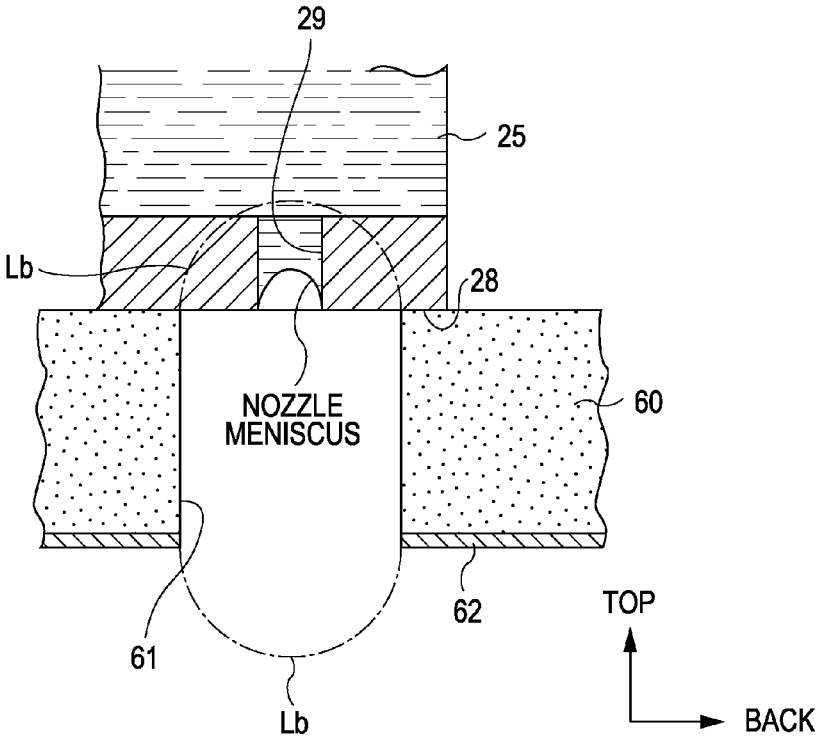
FIG. 11 is a cross-sectional view of an area XI shown in FIG. 9B.

The porous plates 60 (60A and 60B) contain water serving as an ink solvent, and as illustrated in FIG. 11, an evaporation border layer Lb, in which moisture evaporates from the side surfaces of the through-holes 61, is formed. The nozzle openings of the unit heads 25 are positioned within this evaporation border layer Lb. Accordingly, the evaporation of moisture from the nozzle menisci can be suppressed.

In addition, an evaporation prevention layer 62 is formed on the bottom surface of the porous plates 60 (60A and 60B), which is the surface on the opposite side to the nozzles 29 of the unit heads 25 (the surface that opposes the paper surface). The evaporation prevention layer 62 is a metallic foil, a metallic plate, a film that has a low water vapor permeability, or the like. The evaporation of moisture from areas aside from the side surfaces of the through-holes 61 in the porous plates 60 is suppressed by this evaporation prevention layer 62.

As illustrated in FIG. 9B, a tank 71 that holds water is disposed at one end of the porous plates 60 (60A and 60B). One end of the porous plates 60 is immersed in the water of the tank 71, and thus the porous plates 60 are hydrated by the water within the tank 71 through capillarity. Accordingly, the moisture within the porous plates 60 is uniformized. A hydration unit 70, serving as a solvent supply unit, is configured of the tank 71 and an uptake unit 72 that extends from the porous plates 60.

Next, effects of the printer 11 according to the embodiment having the configuration illustrated above will be described focusing on an effect through which the ink is suppressed from thickening at the nozzles using the porous plates 60.

During printing operations, the porous plates 60 (60A and 60B) that hold water are disposed between the nozzles 29 of the unit heads 25 and the paper 12, in a location that is in the vicinity of the nozzle openings, or in other words, a location that is extremely close to the nozzle openings.

Moisture evaporates from the side surfaces of the through-holes 61 in the porous plates 60 (60A and 60B) in the narrow peripheral space that contains the nozzle openings, thus increasing the humidity in the periphery of the nozzles 29. In other words, the periphery of the nozzle openings can be humidified with priority by providing the porous plates 60, from which moisture evaporates, in a location that is extremely close to the nozzle openings. Accordingly, moisture can be suppressed from evaporating from the nozzle menisci at the nozzles 29 of the unit heads (the water in the ink can be suppressed from evaporating at the nozzle openings), thus making it possible to suppress the thickening of the ink. As a result, it is possible to suppress flushing processes (that is, eliminate or reduce flushing processes when printing).

To be more specific, the area extremely close to the nozzle menisci can be held at almost 100% moisture, making it possible to further suppress the evaporation of moisture from the nozzles 29. Accordingly, the effect of suppressing ink thickening can be increased, thus making it essentially unnecessary to carry out flushing processes or the like during printing. In addition, it is no longer necessary to hold unnecessary areas aside from the nozzle menisci at a high humidity, which makes it possible to suppress the amount of water that is evaporated; this in turn makes it possible to reduce the use of the evaporation medium (water) necessary for the humidification, which makes it possible to significantly reduce the consumption of water (the evaporation medium).

When printing operations end and maintenance is to be carried out, the mobile support members 63 and 64 are moved (retracted) in the paper transport direction, thus distancing the porous plates 60 (60A and 60B) from the nozzle formation surface 28 of the unit heads 25. A cap is disposed for the nozzle formation surface 28 of the unit heads 25 at the maintenance position. Note that suction, wiping, and so on may also be carried out.

According to the third embodiment described thus far, the following effects can be achieved.

(1) Water is evaporated in the narrow space that contains the nozzle openings using the porous plates 60 that are disposed in the vicinity of the nozzle openings and that hold water, thus making it possible to suppress the evaporation of water from the ink at the nozzle openings and suppress flushing processes.

(2) The evaporation of water from areas aside from the through-holes 61 of the porous plates 60 can be suppressed by providing the evaporation prevention layer 62 on the surface of the porous plates 60 that opposes the paper surface, which makes it possible to significantly reduce the amount of water (evaporation medium) that is consumed.

(3) When the water in the ink is likely to evaporate from the nozzles 29, it is also likely that water will evaporate from the side surfaces of the through-holes 61 in the porous plates 60; humidification is carried out by evaporating moisture from the side surfaces of the through-holes 61 in the porous plates 60 in accordance with the humidity in the vicinity of the nozzle menisci; and there is a low amount of humidification in environments in which the ink does not thicken quickly in the vicinity of the nozzle menisci. As described above, natural evaporation occurs based on the state of the thickening of the nozzle menisci, thus making it possible to automatically suppress such thickening.

(4) The solvent holding member (60) is a porous material, and thus exhibits superior water retention performance.

(5) Water is supplied to the porous plates 60 by the hydration unit 70, and thus water can be evaporated from the porous plates 60 in a continuous manner.

Fourth Embodiment

Next, a fourth embodiment will be described using FIGS. 12A and 12B. Note that the fourth embodiment differs from the third embodiment only in that the configuration of the solvent supply unit has been changed; because the other configurations are common between the two embodiments, identical constituent elements will be assigned the same reference numerals and detailed descriptions thereof will be omitted.

Figure 12A:
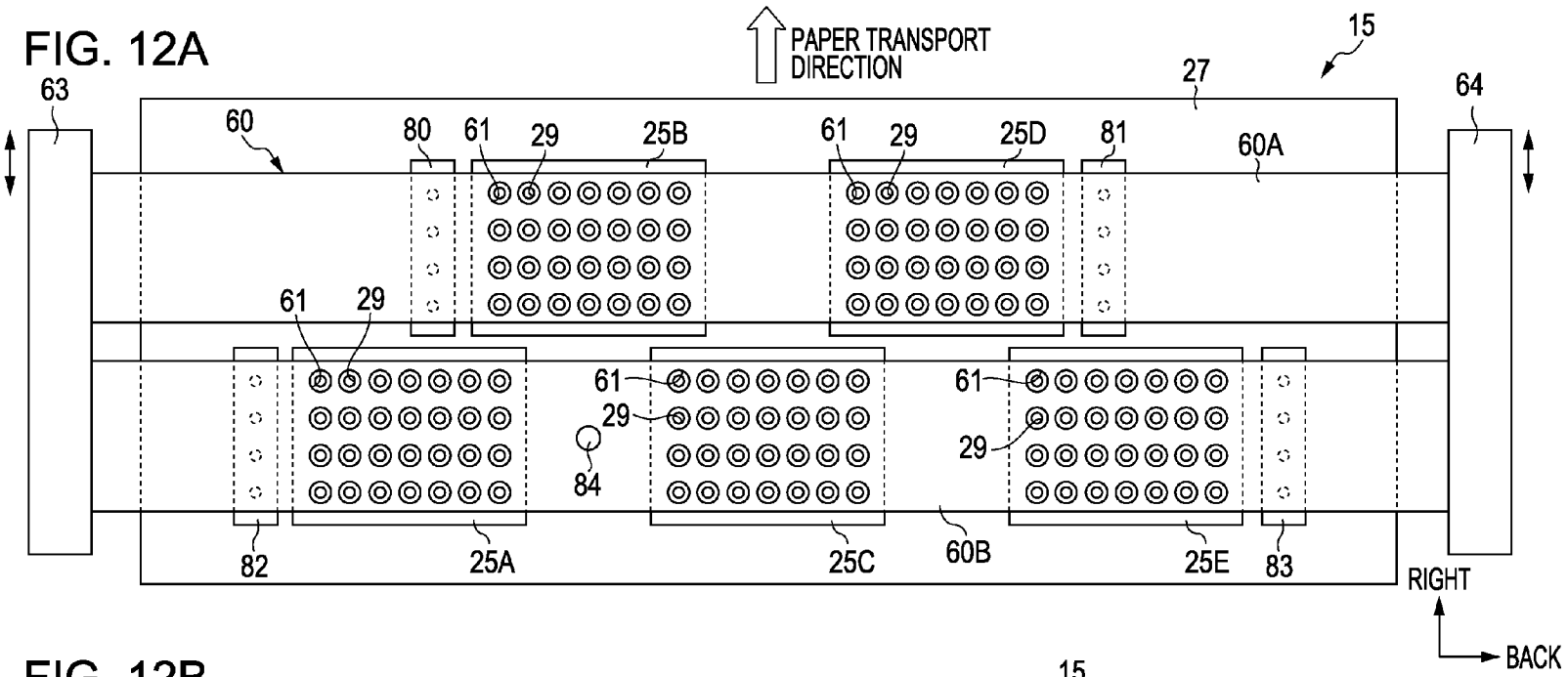
Figure 12B:
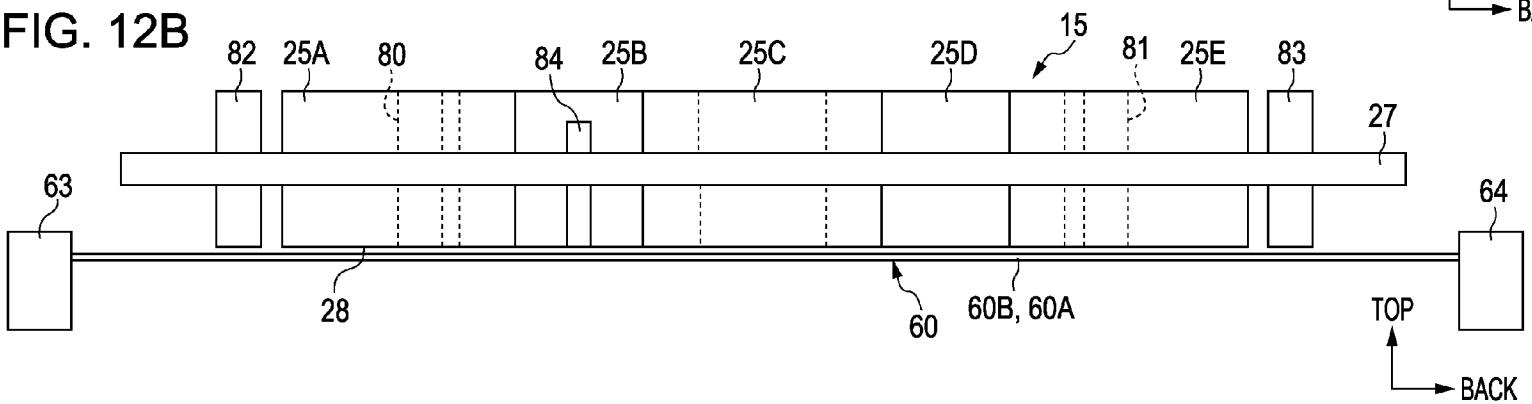
FIG. 12B is a side view schematically illustrating the primary elements of the same printer.

As shown in FIGS. 12A and 12B, in addition to unit heads 25 for line-printing, heads 80, 81, 82, and 83, serving as solvent supply units that eject water, are disposed on both sides of the unit heads 25 for printing. Furthermore, a humidity sensor 84 is provided for the porous plates 60, the humidity sensor 84 making contact with the porous plates 60 and detecting the moisture level thereof. Note that the moisture level can also be detected using a scheme that employs changes in frequency caused by changes in weight.

A drop in the moisture level of the porous plates 60 detected by the humidity sensor 84 is taken as a hydration timing, and water is ejected onto the porous plates 60 (60A and 60B) by the heads 80, 81, 82, and 83. The amount of hydration may be adjusted based on the humidity.

In this manner, in addition to the head units 25 for line-printing, the heads 80, 81, 82, and 83, which eject water, are disposed on both sides of the unit heads 25, and thus the porous plates 60 (60A and 60B) can be hydrated with ease. In addition, the hydration timing for water from the heads 80 to 83, the amount of hydration, and so on can be controlled using a humidity detection unit (the humidity sensor or the like).

Such heads that eject water can be employed favorably, particularly in cases where highly-precise hydration is necessary.

The embodiments of the invention are not intended to be limited to those described above, and other embodiments such as those described hereinafter may also be employed.

Figure 13A:
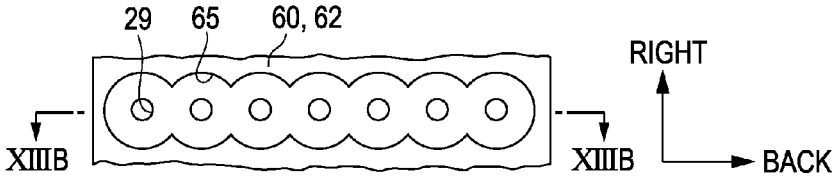
Figure 13B:
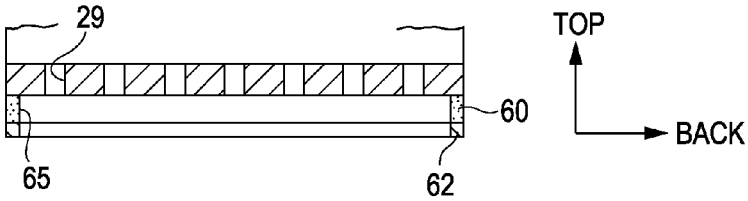
FIG. 13B is a cross-sectional view taken along the XIIIB-XIIIB line shown in FIG. 13A.
Figure 14A:
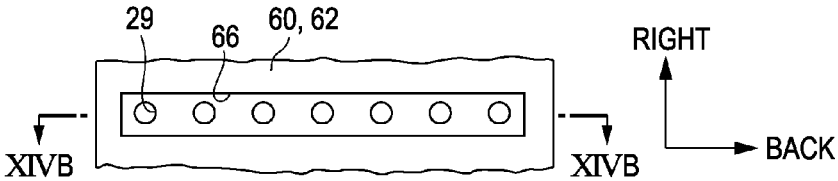
Figure 14B:
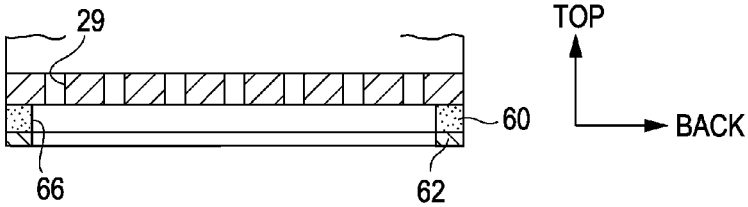
FIG. 14B is a cross-sectional view taken along the XIVB-XIVB line shown in FIG. 14A.
Figure 15A:
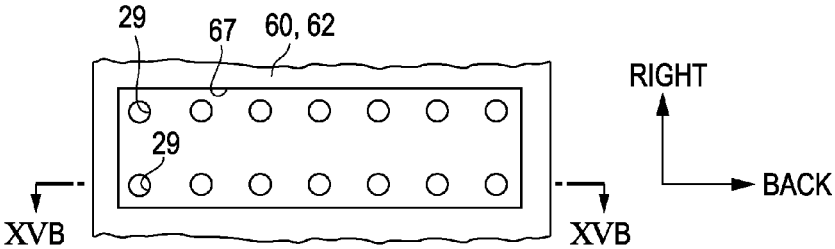
Figure 15B:
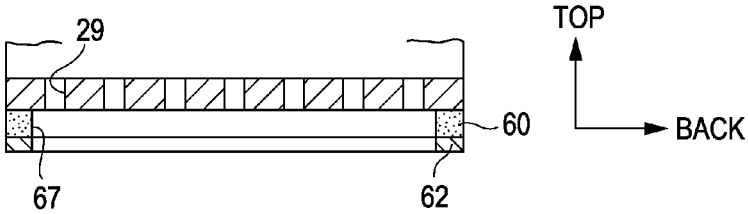
FIG. 15B is a cross-sectional view taken along the XVB-XVB line shown in FIG. 15A.

Although FIG. 9A illustrates a case in which a through-hole 61 is formed in the porous plates 60 (60A and 60B) for each nozzle 29, through-holes 65 for the nozzles 29 may be connected to each other, as shown in FIGS. 13A and 13B, as a variation on this embodiment. Alternatively, as shown in FIGS. 14A and 14B, a rectangular through-hole 66 that extends along the nozzle row may be formed instead. As another alternative, as shown in FIGS. 15A and 15B, a rectangular through-hole 67 that extends along the nozzle rows and encloses multiple rows of nozzles (in FIGS. 15A and 15B, two rows' worth) may be formed instead.

In the first through fourth embodiments, other than natural evaporation, forceful humidification using ultrasonic waves, heating, or the like is also possible.

In the first through fourth embodiments, twisted strings may be used as hydration units for locations that are long, that do not follow a straight line, or the like. For example, water may be supplied from a water tank using the capillarity effect of a twisted string.

In the third and fourth embodiments, the porous plates 60 may be hydrated from a remote location using a thread that can be wound up. Accordingly, the invention can be easily applied in large-size printers that include long heads and the like, making hydration possible by newly feeding out a thread that contains moisture.

Although a water-based ink is used in the aforementioned embodiments, the ink may be non-water-based; in this case, the twisted strings or porous plates are made to hold a solvent aside from water, and are enabled to be supplied with (hydrated with) that solvent.

Although the aforementioned embodiments describe a line-head printer 11 that includes a recording head unit 15 anchored across the entirety of the width direction of the paper 12 as a specific example of a fluid ejecting apparatus, the invention is not limited thereto; the printer may instead be of the serial type, in which printing is carried out onto the paper 12 as a recording head moves in at least one of the depth direction and the horizontal direction while being parallel to the surface of the paper 12 onto which the printing is being carried out. In the case of a serial-type printer, in the first and second embodiments, twisted strings may be disposed so as to be parallel to the nozzle rows of the head, and the twisted strings may be hydrated by ejecting water from water nozzles (water nozzle rows) or the like on both sides using a moving unit to enable the twisted strings to travel slightly. Note that the twisted strings are returned to a predetermined position during printing. Furthermore, in the case of a serial-type printer, in the third and fourth embodiments, water may be ejected from nozzles or the like on both sides of the head.

In the above embodiments, the fluid ejecting apparatus is embodied as the ink jet printer 11, but a fluid ejecting apparatus that ejects a liquid aside from ink may be employed as well. The invention can also be applied in various types of fluid ejecting apparatuses including fluid ejecting heads that eject minute liquid droplets. Note that "droplet" refers to the state of the liquid ejected from the fluid ejecting apparatus, and is intended to include granule forms, teardrop forms, and forms that pull tails in a string-like form therebehind. Furthermore, the "liquid" referred to here can be any material capable of being ejected by the fluid ejecting apparatus. For example, any matter can be used as long as the matter is in its liquid state, including liquids having high or low viscosity, sol, gel water, other inorganic solvents, organic solvents, and fluids such as solutions; furthermore, in addition to liquids as a single state of a matter, liquids in which the particles of a functional material made of a solid matter such as pigments, metal particles, or the like are dissolved, dispersed, or mixed in a solvent are included as well. Ink, described in the above embodiment as a representative example of a liquid, liquid crystals, and the like can also be given as examples. Here, "ink" generally includes water-based and oil-based inks, as well as various types of liquid compositions, including gel inks, hot-melt inks, and so on. The following are specific examples of fluid ejecting apparatuses: fluid ejecting apparatuses that eject liquids including materials such as electrode materials, coloring materials, and so on in a dispersed or dissolved state for use in the manufacture and so on of, for example, liquid-crystal displays, EL (electroluminescence)

displays, surface light emission displays, and color filters; fluid ejecting apparatuses that eject bioorganic matters used in the manufacture of biochips; fluid ejecting apparatuses that eject liquids to be used as samples for precision pipettes; printing apparatuses and microdispensers; and so on. Furthermore, a fluid ejecting apparatus that performs pinpoint ejection of lubrication oils into the precision mechanisms of clocks, cameras, and the like, a fluid ejecting apparatus that ejects an etching liquid of such as acid or alkali onto a substrate or the like for etching, or the like may be employed. The invention can be applied to any type of these liquid ejecting apparatuses.

The entire disclosure of Japanese Patent Application Nos. 2010-002692, filed Jan. 8, 2010, 2010-245972, filed Nov. 2, 2010 are expressly incorporated by reference herein.

What is claimed is:

1. A fluid ejecting apparatus including a fluid ejecting head having a plurality of nozzles that eject a fluid toward a target, the apparatus comprising:

a humidification member that holds water, the humidification member disposed in a position that is opposite to a nozzle formation surface in which the plurality of nozzles of the fluid ejecting head are formed, between the nozzle formation surface and the target but that is not opposite to the plurality of nozzles, wherein the humidification member is disposed between one nozzle of the plurality of nozzles and another nozzle of the plurality of nozzles adjacent to the one nozzle.

2. The fluid ejecting apparatus according to claim 1, wherein the distance between the nozzle and the humidification member is less than an evaporation border layer, the evaporation border layer being an area over which the water from the humidification member.

3. The fluid ejecting apparatus according to claim 1, wherein the humidification member is a thread-shaped member having a diameter that is 10 to 50 times the diameter of the nozzle.

4. The fluid ejecting apparatus according to claim 3, wherein the humidification member is a twisted string.

5. The fluid ejecting apparatus according to claim 1, wherein the humidification member is made of a porous material, and a through-hole through which the fluid ejected from the nozzle passes is formed in a location in the porous material that corresponds to the nozzle of the fluid ejecting head.

6. The fluid ejecting apparatus according to claim 5, wherein an evaporation prevention layer is formed on the surface of the humidification member made of the porous material that is on the opposite side to the nozzle of the fluid ejecting head.

7. The fluid ejecting apparatus according to claim 1, further comprising a water supply unit that supplies the water to the humidification member.

* * * * *